US006170209B1

(12) United States Patent
Dagher et al.

(10) Patent No.: US 6,170,209 B1
(45) Date of Patent: Jan. 9, 2001

(54) PRESTRESSING SYSTEM FOR WOOD STRUCTURES AND ELEMENTS

(75) Inventors: Habib Dagher, Vezie; Beckry Abdel-Magid, Orono, both of ME (US)

(73) Assignee: University of Maine, Orono, ME (US)

( * ) Notice: Under 35 U.S.C. 154(b), the term of this patent shall be extended for 0 days.

(21) Appl. No.: 08/964,541

(22) Filed: Nov. 5, 1997

Related U.S. Application Data

(60) Provisional application No. 60/030,305, filed on Nov. 5, 1996.

(51) Int. Cl.[7] ..... E04C 5/08

(52) U.S. Cl. ..... 52/223.1; 52/223.8; 52/223.9; 52/223.11; 52/223.13; 52/223.14; 52/223.7

(58) Field of Search ..... 52/223.1, 223.8, 52/223.9, 223.12, 223.13, 223.14, 231, 223.4, 223.5, 223.6, 223.7, 741, 223.11

(56) References Cited

U.S. PATENT DOCUMENTS

| | | | | |
|---|---|---|---|---|
| 1,867,185 | * | 7/1932 | Sorensen | 52/231 |
| 2,644,497 | * | 7/1953 | Wilmer et al. | 52/223.13 |
| 3,778,946 | * | 12/1973 | Wood et al. | 52/223 R |
| 4,047,335 | * | 9/1977 | Darmstadt | 52/2 |
| 4,856,254 | * | 8/1989 | Jngwirth | 52/741 |
| 4,965,973 | * | 10/1990 | Engebretsen | 52/233 R |
| 4,999,959 | * | 3/1991 | Virtanen | 52/230 |
| 5,540,030 | * | 7/1996 | Morrow | 52/742.13 |
| 5,580,642 | * | 12/1996 | Okamoto et al. | 428/212 |
| 5,653,080 | * | 8/1997 | Bergeron | 52/729.4 |
| 5,802,788 | * | 9/1998 | Ozawa et al. | 52/223.13 |
| 5,809,713 | * | 9/1998 | Ray | 52/223.9 |
| 5,840,247 | * | 11/1998 | Dubois et al. | 422/7 |

* cited by examiner

*Primary Examiner*—Christopher T. Kent
*Assistant Examiner*—Jennifer I. Thissell
(74) *Attorney, Agent, or Firm*—Michael J. Persson; Lawson, Philpot & Persson, P.C.

(57) ABSTRACT

The present invention is a prestressing system for wood elements and structures and a method from prestressing wood beams. In its most basic form, the system for prestressing structures comprises a plurality of members arranged in a predetermined configuration, at least one non-metallic prestressing tendon, having a material stiffness less than that of steel, disposed in such a manner as to fasten together the members, and stressing means attached to at least one end of the prestressing tendon to exert a tensile force on the tendon and an equal and opposite compressive force drawing the members together. In the preferred embodiment, the tendons are manufactured from fiber reinforced plastic and the members are arranged in side by side relation to form a deck. The deck includes a series of aligned holes through the members, through which the prestressing tendons pass and are secured and prestressed. In alternate embodiment of the invention, prestressing tendons are used to secure and prestress stress laminated T sections and box sections and to secure timber trusses. The present invention is also directed to a system and method for prestressing beams. In its most basic form, the system comprises at least one nonmetallic tendon, at least one opening disposed longitudinally through a lower portion of the element, a pair of anchors disposed at the ends of each prestressing tendons, and a pair of bearing plates disposed between the anchors and the bearing surface of the beam. In operation, the tendons are disposed within the opening, the bearing plates are disposed against the bearing surfaces and the anchors are tightened such that a tensile force is exterted on the tendons and such that said bearing plates exert a substantially equal an opposite compressive force on the element beam. In an alternate embodiment, the opening is filled along the tendon with a resin and the anchors are removed after the resin has cured.

16 Claims, 8 Drawing Sheets

PRESTRESSING SYSTEM FOR WOOD STRUCTURES AND ELEMENTS

REFERENCE TO RELATED APPLICATIONS

This Application is a conversion of U.S. Provisional Patent Application Ser. No. 60/030,305, filed on Nov. 5, 1996.

BACKGROUND OF THE INVENTION

1. Field of the Invention

The invention relates to the prestressing of wood elements and structures to improve structural performance.

2. Description of the Related Art

A number of wood elements and structures may be prestressed or post-tensioned to improve their structural performance. For example, glulam beams and girders may be post-tensioned to increase their strength, stiffness and ductility or to reduce the amount or quality of wood required. Engineered wood trusses such as king and queen-post trusses rely on post-tensioning forces to keep their structural integrity, and stress-laminated bridges, decks or panels rely on the prestressing forces to increase their load-distribution characteristics thus their strength, stiffness and ductility.

While wood prestressing has many structural advantages, commercial applications of prestressed structural wood have been very slow to take hold. One major reason for this has been the difficulty to maintain prestress forces over the life of the wood structure. Wood structures and elements tend to lose prestress rather quickly over time due to a number of mechanisms particularly: creep in the wood system, creep of the wood in the high stressed areas near the prestress anchors and shrinkage of the wood due to loss of moisture. Loss of prestress or fluctuations of prestress forces are even more pronounced in structures such as bridges where hygro-thermal-mechanical interactions between the wood structure and its environment are very significant. In such structures, e.g. stress-laminated wood decks, current design practices require very high initial prestress forces, and require periodic re-stressing of the structure in service. These necessary requirements are cumbersome and expensive to apply and often turn engineers and designers away from using prestressed wood systems.

As part of on-going United States Department of Agriculture (USDA) and Federal Highway Administration (FHWA) timber bridge initiatives, many modem timber bridge designs have been developed and used in the US. Some of the most popular designs are now referred to as stress-laminated decks or bridges. In these bridges, longitudinal wood or engineered wood laminations, consisting of either solid sawn lumber, glulam girders, LVL girders, or a combination of these are post-tensioned transverse to traffic. The prestress force causes friction to develop between the wood laminations, enhancing the load sharing capacity of the system and causing the behavior of the individual laminations to approach that of a continuous orthotropic plate.

While stress-laminated timber bridges can be cost-effective and relatively easy to assemble, one of their biggest draw-backs is the need to periodically re-tension them in service. Creep in the wood laminations over time or drying of the wood in service can cause significant losses of prestress. According to the AASHTO Guide Specification for Stress-Laminated Decks, the initial prestress $p_i$ applied to the deck should be 2.5 times the minimum required value p to compensate for losses due to creep and relaxation. Also, the AASHTO Guide Specification calls for re-stressing the deck to the same initial level $p_i$ during the second and again between the fifth and eighth weeks after the first laminating.

The serviceability and structural integrity of stress-laminated bridges depend on maintaining minimum levels of prestress over the long-term. Because of insufficient data on long-term prestress losses in service for various wood species, various wood preservatives, and various environments, stress-laminated bridges constructed in the state of Maine and many other states are now being monitored and periodically re-stressed in service as part of regular long-term maintenance and evaluation programs. Department of transportation engineers and maintenance personnel are often not at ease with a bridge design that needs periodic re-stressing. Another source of concern is the durability of the metal stressing systems in use today when embedded inside treated timber. Because of these concerns, widespread use of stress-laminated bridges appears to hinge on developing a stressing system that requires minimum maintenance in service. That is, an ideal stressing system would be one that (1) does not require re-stressing in service and (2) is made of a durable material system that is resistant to corrosion and other long-term environmental degradation.

An early study on prestress loss in stress-laminated wood systems was conducted at Queen's University using small-scale laboratory models post-tensioned using 19 mm Grade 5 steel threaded bars. The test results showed that the prestress loss may be as high as 65% of the initial prestress over the long term. Restressing could however reduce the prestress loss to 45% of the initial prestress. Subsequent restressing did not show any further reduction of prestress loss. About 50% prestress loss was observed in the Herbert Creek Bridge, the first stress-laminated wood bridge deck, constructed in Ontario, Canada. Another laboratory study of prestress loss conducted on a 14 m×3 m deck at the University of Wisconsin showed that the long-term prestress loss exceeds 50%.

In the past, two ways have been proposed to reduce prestress losses in stresslam wood bridges. One way may be to install the bridge at a moisture content (MC) below the expected Equilibrium Moisture Content (EMC) for the site. In the state of Maine, for example, the EMC on membrane-covered and paved CCA-treated timber bridges was found to be nearly 19%. Installing a bridge at a MC<19% will cause the wood to expand in service as it reaches its EMC of 19%. The wood expansion may compensate in part for the loss of prestress in the deck. However this method is not entirely reliable because the prestress levels in the bridges become "at the mercy" of uncertain environmental conditions. An extended dry period may cause prestress forces to drop again to dangerously low levels.

Another way to reduce the prestress losses may be to use curved-washer type spring stacks (Belleville springs) in series with the steel prestressing rods or tendons. The idea is that the springs will absorb some of the movements of the wood in service, leading to a more stable prestress force and reduced losses. Belleville spring stacks were installed on one-half of a stress-laminated timber deck constructed in Maine in 1991 to test this concept. The other half of the bridge used steel threaded rods with no Belleville springs. The Belleville spring stacks added considerable cost to the system (nearly $50/steel stressing rod). They were also difficult to handle and they made it difficult to tension the bridge. Long-term monitoring of prestress levels in the deck indicated little difference in prestress between the half of the bridge with the Belleville springs and the other half of the bridge. The lack of effectiveness of the Belleville springs in this application was attributed at least in part to the corrosion of the spring stacks which caused them to partially "lock" in place. Corrosion protection of these sizable spring stacks would be possible but costly.

SUMMARY OF THE INVENTION

The present invention is a prestressing system for wood elements and structures that overcomes the aforementioned shortfalls of prior art systems. In its most basic form, the system for prestressing structures comprises a plurality of members arranged in a predetermined configuration, at least one non-metallic prestressing tendon, having a material stiffness less than that of steel, disposed in such a manner as to fasten together the members, and stressing means attached to at least one end of the prestressing tendon and adapted to exert a tensile force on the tendon and a substantially equal and opposite compressive force on the members such that the members are drawn together.

In the preferred embodiment of the system, the prestressing tendons are manufactured from fiber reinforced plastic and the members are arranged in side by side relation to form a deck. The deck includes a series of aligned holes through the members through which the prestressing tendons pass and are secured and prestressed.

In an alternate embodiment of the system, the members are arranged between at least two girders to form a series of T shaped structures and a prestressing tendon is passed through aligned holes in the members and girders to secure and prestress the structure.

In another embodiment of the system, the members are arranged in two rows between opposite ends of at least two girders to form a series of box shaped structures. A pair of prestressing tendons passed through aligned holes in each end of the members and girders to secure and prestress the structure.

In still other embodiments of the invention, the members are arranged to form a truss with the prestressing tendon securing the free ends of the truss. In one such embodiment, a three member "King" truss is formed, while in another embodiment, a two member "Queen" truss is formed.

The system of the present invention is also directed to the prestressing of elements. In its most basic form, the system comprises at least one non-metallic tendon, at least one hole disposed longitudinally through a lower portion of the element, a pair of anchors disposed at the ends of each prestressing tendons, and a pair of bearing plates disposed between the anchors and the bearing surface of the beam. In operation, the tendons are disposed within the holes, the bearing plates are disposed against the bearing surfaces and the anchors are tightened such that a tensile force is exterted on the tendons and such that said bearing plates exert a substantially equal an opposite compressive force on the element beam.

In the preferred embodiment of this system, the prestressing tendons are manufactured from glass fiber reinforced plastic and the element comprises a glulam beam formed of a plurality of laminated layers and the bearing surfaces are recessed within a series of counterbores in the beam such that the anchors and bearing plates do not protrude beyond the ends of the beam.

In still another embodiment of the invention, a resin is disposed within the holes in the beam, after the prestressing tendon has been secured and tightened, to hold the tendon in a prestressed position.

Therefore, it is an aspect of the invention to provide a prestressing system for wood elements and structures that reduces prestress losses.

It is another aspect of the invention to provide a prestressing system for wood elements and structures that reduces the level of initial prestress required.

It is another aspect of the invention to provide a prestressing system for wood elements and structures that reduces the incidences of necessary re-stressing of structures in service and correspondingly reduces the lifetime costs of these structures.

It is another aspect of the invention to provide a prestressing system for wood elements and structures that results in a safer structure having a more stable prestress force over its lifetime.

It is another aspect of the invention to provide a prestressing system for wood elements and structures that reduce the size and cost of the prestress system.

It is still another aspect of the invention to provide a prestressing system for wood elements and structures that reduces the length of time required to perform the initial stressing operation in stresslam systems.

These aspects of the invention are not meant to be exclusive and other features, aspects, and advantages of the present invention will be readily apparent to those of ordinary skill in the art when read in conjunction with the following description, appended claims and accompanying drawings.

DETAILED DESCRIPTION OF THE INVENTION

Figure 1:
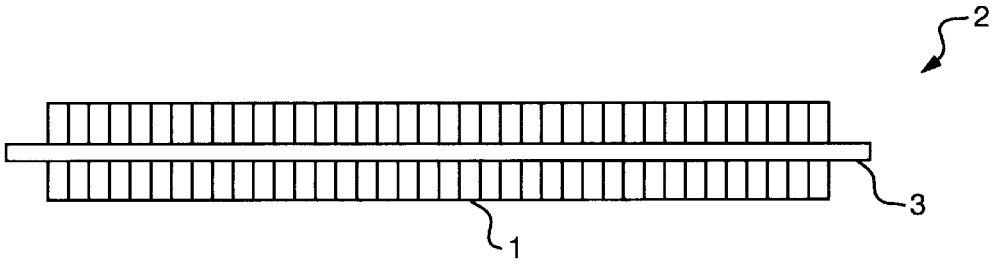
FIG. 1 is a side section view of a solid stress-laminated deck cut away to show a prestessing tendon.

The present invention includes any prestressed or post-tensioned structural wood component or system in which, for the purpose of reducing prestress losses, the prestressing elements have a material stiffness less than that of steel. This is referred to as a Reduced Stiffness Wood Stressing System (RSWSS). For wood components or systems, the reduction of the material stiffness of the prestressing elements has been shown by experimentation to:

(1) Reduce prestress losses in the wood component or system (2) Reduce the level of initial prestress required (3) Possibly eliminate the need to re-stress a structure in service (4) Achieve a safer structure having a more stable prestress force over its lifetime, i.e. a prestress force that is less sensitive to seasonal moisture changes in the wood and other environmental factors (5) Reduce the size and cost of the prestress anchors (6) Reduces the length of the initial stressing operation in stresslam systems (7) Reduce the lifetime cost of a structure by virtually eliminating the need to re-stress and maintain the structure in service.

The larger the reduction of the material stiffness of the prestressing elements, the larger the positive effects of the six benefits listed above. Also, to maximize benefits, reduction of the stiffness of the prestressing material system cannot come at the expense of either significant increases of the creep/relaxation properties of the material nor significant reductions in strength of the stressing system. Clearly, the cost and environmental durability of both the material and anchor systems will affect the commercial viability of the RSWSS.

To illustrate and explain the invention, it is useful to focus on one specific application. The impact of the invention on stress-laminated bridges is illustrative, with the understanding that the invention is clearly not limited to this application. Stress-laminated bridges are selected as an example because they represent a worst-case scenario for prestress loss in wood systems.

The ability of the RSWSS to cut prestress losses may be explained as follows. Assume a RSWSS has a stiffness equal to one-fourth that of steel. Also consider two identical stresslam wood decks (FIG. 1): one prestressed with steel tendons and the other prestressed with the RSWSS tendons. Also assume, for the sake of the discussion, that the applied prestress force in the wood is kept constant in both decks over three-months by applying additional external stress to the wood to compensate for any prestress losses in the internal stressing tendons. Also assume that both decks will lose moisture from 21% moisture content (MC) to 19% MC over the three-month period.

Since the wood prestress level in both decks is identical, both will experience the same net amount of creep deformation at the end of the three-month period. Similarly, both decks will experience the same amount of drying shrinkage. At the end of the three-months, both decks would experience the same amount of total deformation due to the sum of creep and drying shrinkage, so will the steel and RSWSS tendons. Since the steel tendons are four times stiffer than the RSWSS tendons, percentage-wise, the steel will lose four times as much prestress than the RSWSS.

In practice, however, the four-to-one difference in percent prestress loss will not hold true because the prestress force is not held constant in the decks by external means. If the prestress force is not kept constant by using additional external forces, the steel tendons will lose stress faster than the RSWSS because of the steel's high stiffness, which will in turn reduce the rate of creep deformation in the steel-stressed wood deck. In other words, assuming the same initial prestress, the RSWSS deck will hold a higher average stress than the steel deck over the same three-month period.

The above discussion assumes that there are negligible differences in the relaxation properties of the RSWSS and steel systems and that there are negligible differences in the anchorage losses between the two systems. Both are important design features in a successful RSWSS.

The present invention is adapted for use with a variety of structures including all transversely stressed longitudinal decks or bridges having longitudinal solid-sawn laminations, longitudinal glulam laminations, longitudinal T-sections or box-sections, stresslam bridges made with glulam or LVL webs and solid-sawn or glulam flanges, or stressed MPC truss bridges that are prestressed and/or post-tensioned with RSWSS tendons as described above. In addition, the present invention is adapted for use with structural elements such as beams as both a prestressing and post-tensioning device.

Referring to FIG. 1, a side view of a solid stress-laminated deck 2 utilizing the RSWSS of the present invention is shown. Decks of this type typically utilize either stacked lumber or glulam laminations arranged in side by side relation such that the ends of each lamination 1 are substantially parallel to one another. A series of holes are drilled in through each lamination 1 such that, when the laminations 1 are arranged, the holes are aligned with one another allowing a prestressing tendon 3 to pass through the holes in deck 2 and be secured. The number of prestressing tendons 3 utilized depends upon the length of the laminations 1, but at least one tendon 3 is always used.

Figure 2:
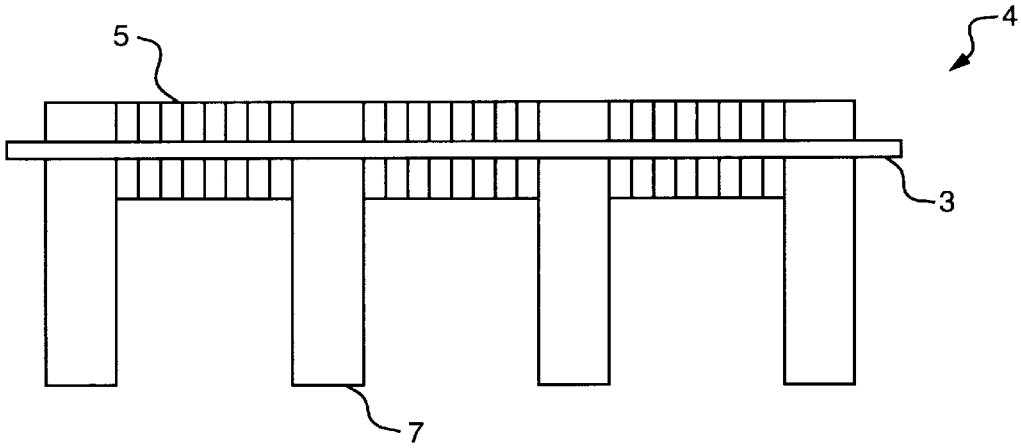
FIG. 2 is a side section view of a stress-laminated T cut away to show a prestessing tendon.

Referring now to FIG. 2, a stress laminated T section 4 according to the present invention is shown. The stress laminated T section is made up of a series of girders 7 aligned substantially parallel to one another. Girders 7 are preferably either glulam, LVL, or SCL, but other types of girders known to be suitable for use with T sections held by steel tendons could be used to produce similar results. Between girders 7 are aligned a series of laminations 5, similar to the arrangement of the deck 2 of FIG. 1. The ends of laminations 5 are aligned with the ends of girders 7 such that a series of T sections 4 are formed. As was the case with the deck 2 of FIG. 1, a series of holes are drilled through laminations 5 and girders 7 such that the holes are aligned when the girders 7 and laminations 5 are arranged to allow a prestressing tendon 3 to pass through the structure and be secured.

Figure 3:
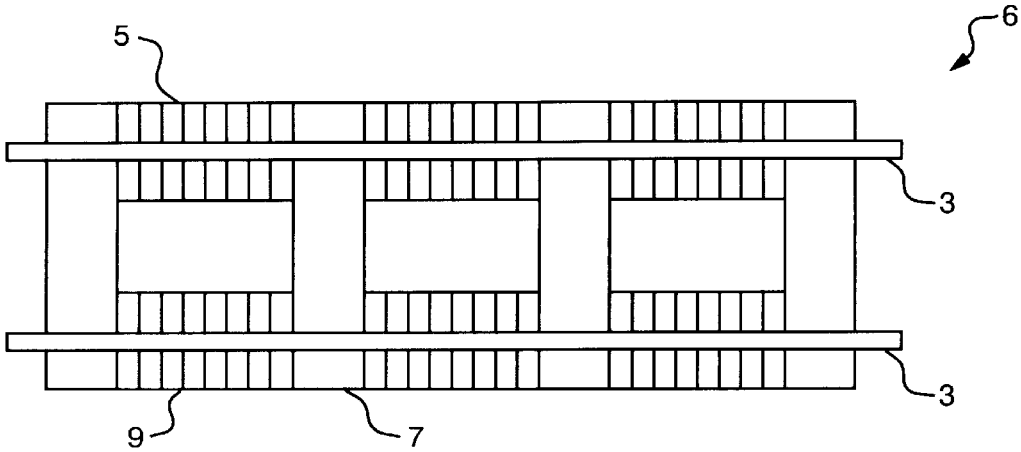
FIG. 3 is a side section view of a stress-laminated box cut away to show a prestessing tendon.

Referring now to FIG. 3, a stress laminated box section 6 is shown. Box section 6, is essentially the same as the T section 4 of FIG. 2 except that box section 6 utilizes a second series of laminations 9 arranged at the bottom ends of girders 7 and a second prestressing tendon 3. The addition of the second series of laminations 9 and the second prestressing tendon 3 secures the sections together and forms a series of structural box sections 3.

Figure 4A:
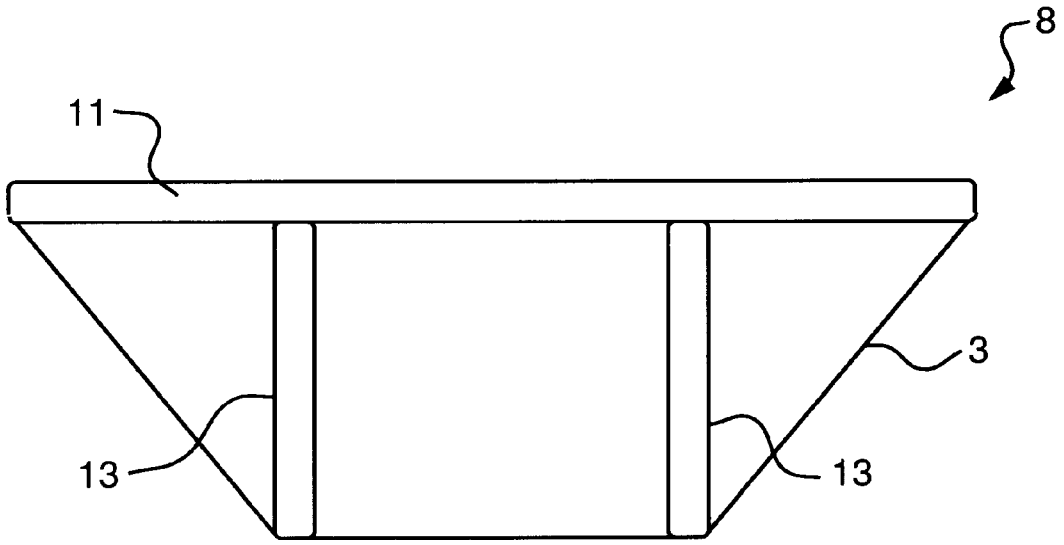
FIG. 4*a* is a front view of a King-post wood truss utilizing a prestessing tendon.
Figure 4B:
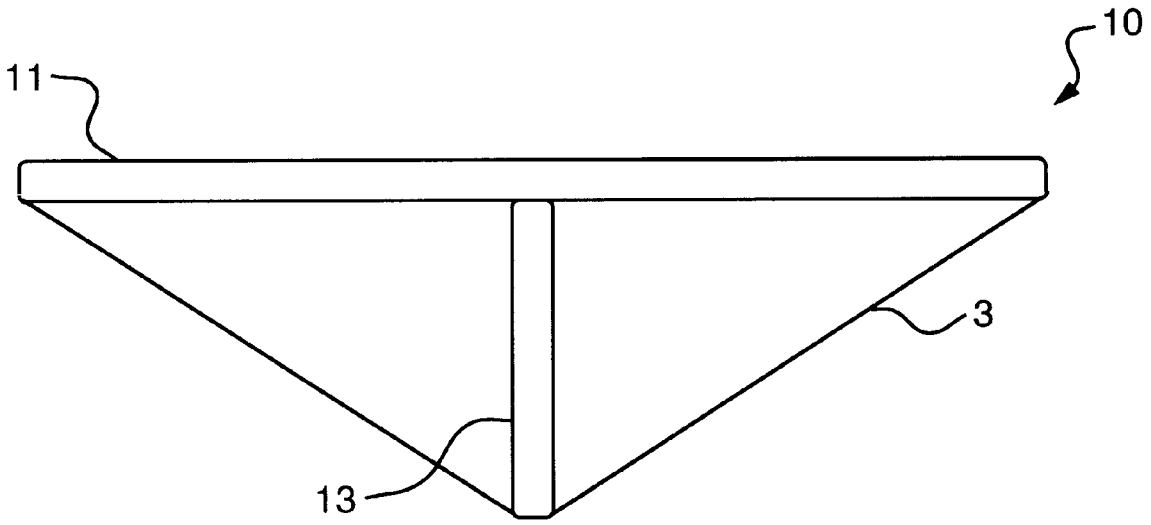
FIG. 4*b* is a front view of a Queen-post wood truss utilizing a prestessing tendon.

Referring now to FIGS. 4*a* and 4*b*, King-post and Queen-post trusses of the present invention are shown. FIG. 4*a* shows a typical King-post truss 8 made up of a girder member 11 and a pair of post members 13 extending substantially perpendicularly from the girder member 11 and utilizing a RSWSS prestressing tendon 3 to draw the three members together, effectively post-tensioning the system. Tendon 3 is secured to each end of girder member 11 and extends across, and is secured to, the free ends of post member 13. FIG. 4*b* shows a typical Queen-post truss 10, similar to the King-post truss 8 of FIG. 4*a* except that only one post member 13 is utilized.

The preferred embodiment of the present invention utilized prestressing tendons made from Glass Fiber-Reinforced-Plastic (GFRP) for prestressed wood components and systems, but is not restricted to the use of these materials. Similarly, stressing bars or rods may be used in place of tendons in many applications to achieve similar results. Laboratory experimentation has shown that with 50%–65% E-glass by volume, it is possible to fabricate GFRP with tensile strength exceeding 100 ksi and stiffness in the order of $6–7\times10^6$ psi (Higher tensile strength properties may be achieved with S-Glass). Experimentation has also shown that it is possible to practically ignore relaxation of these tendons when they are stressed to approximately 50% or less of their ultimate strength, though stresses of less than or equal to 30% of ultimate are preferred. GFRP with the material properties and stressing levels described here satisfy the conditions for an excellent RSWSS.

For stress-laminated wood systems, experimentation has shown that GFRP tendons as described can reduce prestress losses normally seen with high-strength steel threadbar systems (such as commonly used DYWIDAG steel threadbars) by a factor of nearly two to three. As a result, the initial wood prestress level $p_i$ does not need to be as high as 2.5 p, where p is the final wood prestress level after losses. Experimentation has shown that values of $p_i$ may be taken as low as 1.5 p. For example, rather than using an interlaminar prestress, $p_I$, of 125 psi as is normally done with steel threadbars, values as low as $p_i$=75 psi with GFRP tendons have been found adequate. With GFRP tendons, the residual prestress is nearly 60 psi after 70 days and nearly stable with a low intitial prestress, $p_I$, of 75 psi. With steel threadbars, the residual prestress is also about 60 psi after 70 days, and nearly stable, but at a much higher initial prestress, $p_I$, of 125 psi.

GFRP tendons satisfying the requirements for RSWSS may be obtained through the StressSteel Company of S. Dakota. GFRP tendons and anchors produced by the StressSteel Company have been tested and will perform as described above. However, it is understood that other GFRP tendons exhibiting similar properties may be substituted to achieve similar results.

In addition to the reductions in prestress losses and the initial prestress required, the number of passes needed to complete the initial stressing is significantly reduced and, because of the reduced initial prestress levels, the size and cost of the prestress anchors/bearing plates are both reduced. The GFRP tendons can be more durable than epoxy-coated or galvanized steel in many exposed environments. In addition to their low modulus, GFRP tendons are also desirable because of their low cost compared to other FRP systems such as carbon or KEVLAR.

Table 1 summarizes preferred embodiments of the present invention for application to stresslam systems. Table 1 should not be construed to limit the RSWSS to the ranges and properties shown in the table:

Table 1. Preferred Embodiments of the invention in stresslam decks and bridges

| Item | Preferred properties |
|---|---|
| RSPWSS | GFRP tendon (E or S-Glass) Stressed Steel Company, S. Dakota |
| GFRP tendon reinforcement | 50–65% glass by volume |
| GFRP tendon -- end-anchor | GFRP transitioned to threaded bar or use protected anchor with prestress chucks |
| GFRP tendon Stiffness | 6-7 $10^6$ psi |
| GFRP tendon strength | 100 + ksi |
| Sustained prestress in GFRP tendon | <40% of ultimate strength |
| Initial wood prestress, $p_i$ | ≧1.5 p, ≧75 psi |
| Long-term remaining wood prestress p | >50 psi |

-continued

| Item | Preferred properties |
|---|---|
| Number of initial stressing passes | As low as two passes may be sufficient |
| Number of re-stressing in service after initial stressing | possibly none required |
| Prestress anchor plate | single GFRP plate |

Figure 5A:
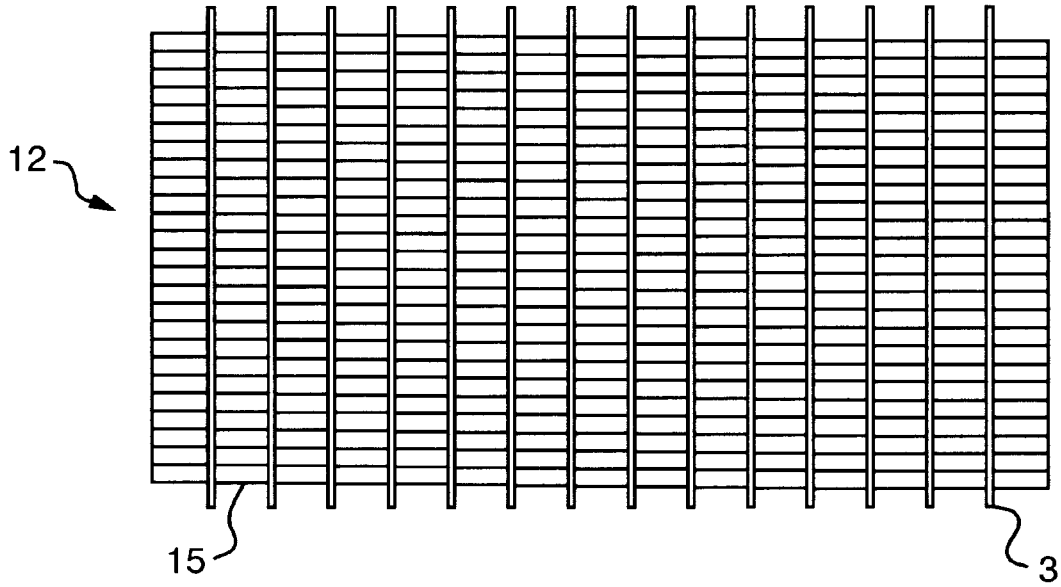
FIG. 5*a* is a top section view of a transverse stresslam deck over longitudinal girders
Figure 5B:
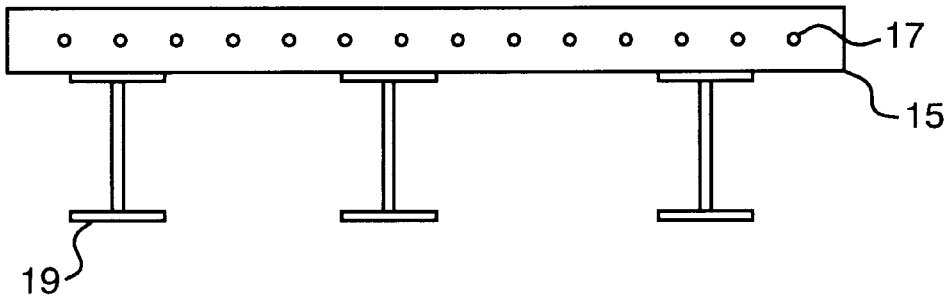
FIG. 5*b* is an end view of the deck and girders of FIG. 5*a*

The present invention may also be applied to longitudinally stressed solid wood decks over steel, concrete or wood girders. As shown in FIGS. 5*a* & 5*b,* the decks 12 are made with sawn lumber units 15 placed on edge perpendicular to traffic. The tendons 3, placed parallel to traffic through aligned holes 17 in the wood panels 15, need only be stressed once during construction. Prior to the invention, it was impractical to use longitudinal prestressing on bridge decks. This is because it was necessary to restress the bridge in service and there was no practical or inexpensive way of gaining access to the end of the tendons 3 near the ends of the bridge once the bridge is in service. With the present invention, the end anchors can be permanently "buried" in the end abutments since the wood deck does not need to be re-stressed in service.

Figure 6A:
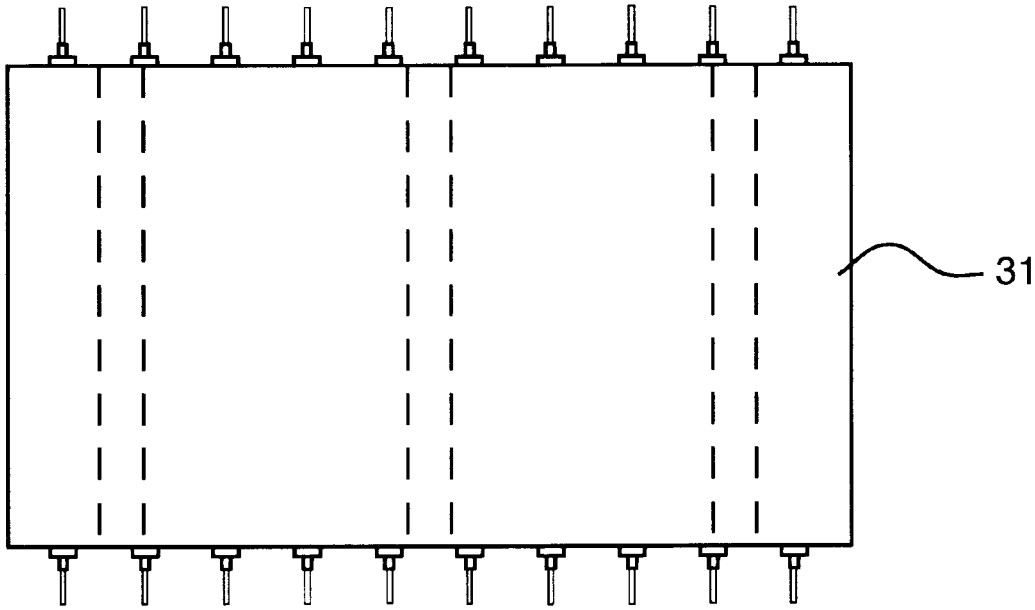
FIG. 6*a* is a top plan view of a transverse stresslam deck.
Figure 6B:
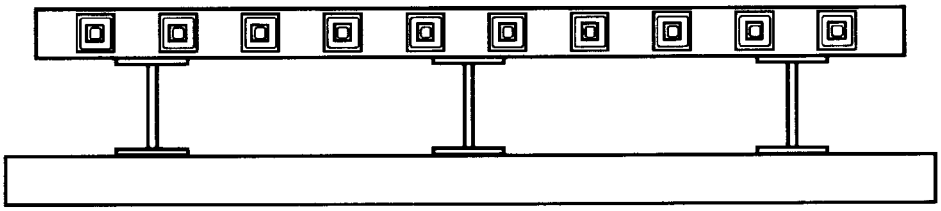
FIG. 6*b* is a transverse section view of the transverse stresslam deck of FIG. 6*a* over longitudinal girders.
Figure 7:
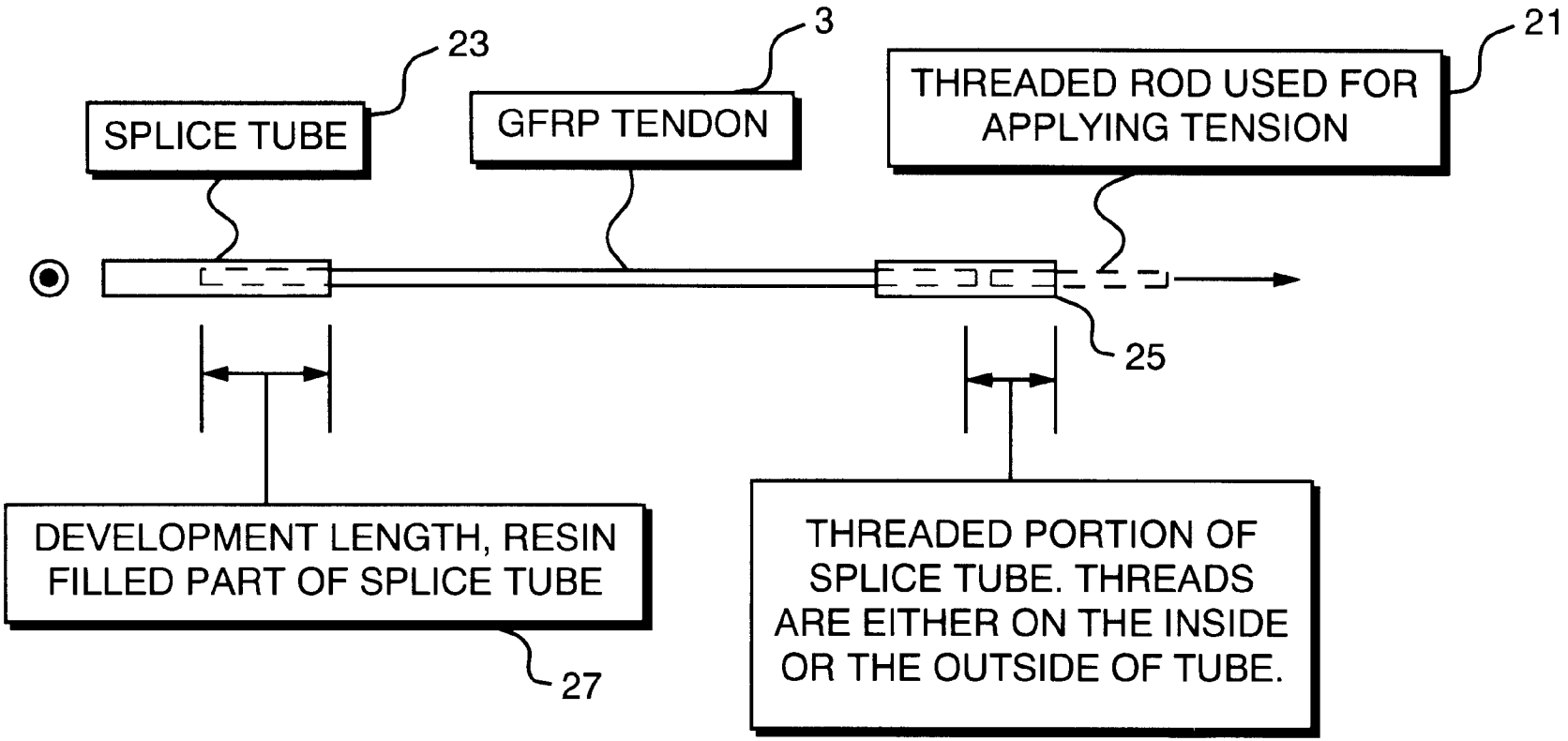
FIG. 7 illustrates the laboratory test configuration used to test prestress losses in GFRP tendons.

An example of a transverse stresslam deck over steel girders constructed for experimentation purposes is shown in FIGS. 6*a* & 6*b.* To eliminate initial differences in anchor set between the GFRP and steel threadbar systems (such as a DYWIDAG systems), one end of the GFRP tendon 3 was transitioned to a steel threaded bar 21 as shown in FIG. 7. Such an anchoring system included a splice tube 23 having a threaded portion 25 adapted to accept threaded rod 21, and a development length 27 which is filled with resin to adhere to the tendon 3. It should be noted that, in other embodiments, the threaded portion 25 may have threads on the outside of the tube rather than the inside. Thus the GFRP tendon may be tensioned in the same manner as the DYWIDAG steel threaded bars, i.e. by pulling on the steel threaded bar end using a center-hole jack and tightening the nut on the steel extension rod. The other end of the GFRP tendon was reinforced so that a common prestressing chuck may be used as a dead-end anchor.

The loss of prestress test was conducted on an approximately 5 m×3 m stress-laminated wood deck 31, in which rough-sawn 5 mm×25.4 mm (2 inch×10 inch) eastern hemlock wood laminations ran in the 5 m direction and the GFRP tendons ran in the 3 m direction. There were ten GFRP tendons in the deck and six of them were instrumented using load cells. To eliminate the effect of the load cells on the stiffness of the system, two different types of load cells were mounted on the tendons. Two of the load cells were ENERPAC hydraulic load cells. The other four were electronic load cells manufactured by the SENSOTEC Co. The six load cells were distributed among the ten GFRP tendons.

The prestress force data from the ENERPAC hydraulic load cells were observed through a pressure gage mounted directly on the load cells. The readings from the electronic load cells were collected using a standard strain indicator. Every load cell was calibrated under a hydraulic universal testing machine before mounting it on the deck. The creep test was conducted in a sensibly constant indoor environment with temperatures ranging from 24° C. to 27° C. (75 to 80° F.). Although there was a larger fluctuation of the relative humidity inside the lab (21%–54%), the moisture content of the wood remained below 6 percent throughout the creep test. The test was then monitored daily for 70 days.

The initial prestress introduced between the wood laminations was 520 kPa (75 psi). The corresponding prestressing force in each GFRP tendon was 62 kN (14 kips). The GFRP tendons, obtained through the SteelStress Co., have an ultimate tensile strength of 116 kN (26 kips). The 63 kN (14 kips) initial tendon stressing force is 54% of the tendon's ultimate strength. This value was used to provide a factor of safety of nearly two against static failure of the GFRP tendon. The 520 kPa (75 psi) initial prestress introduced between the wood laminations is lower than the 860 kPa (125 psi) commonly used with steel stressing systems. This lower initial prestress was utilized to take advantage of the lower prestress losses with the GFRP system.

The initial prestress was applied using an ENERPAC center-hole hydraulic jack with tensile forces in each tendon being brought up to 63 kN (14 kips) sequentially from one end of the deck to the other. Only two passes were required before the desired prestress force in the first tendon (that was stressed in the second pass) was within 5% of the target value of 63 kN (14 kips). This is a significant development because comparable steel stressing systems may require as many as five or more passes before the target forces in the prestressing bars are reached. This reduction in the time to complete the stressing operation is a direct result of the lower stiffness of the GFRP tendons, which is about one-fourth that of steel. With the steel system, when one of the bars is tensioned, the reduction in the deck dimensions causes the adjacent steel bars to lose a significant amount of force. With the more flexible GFRP tendons, the same reduction in the deck dimensions causes the tendons to lose only about one-fourth as much force as comparable steel tendons.

The rate of prestress loss is higher in the initial period of time immediately following the completion of the stressing operation. The prestress force data taken 12 hours after the completion of the initial stressing showed 5% prestress loss on the average. The higher rate of prestress loss in the first twelve hours may be at least partly attributed to continued gap closing between the wood laminations. Once the gaps between the wood laminae are mostly closed, the prestress losses may be attributed largely to creep in the wood.

Figure 8:
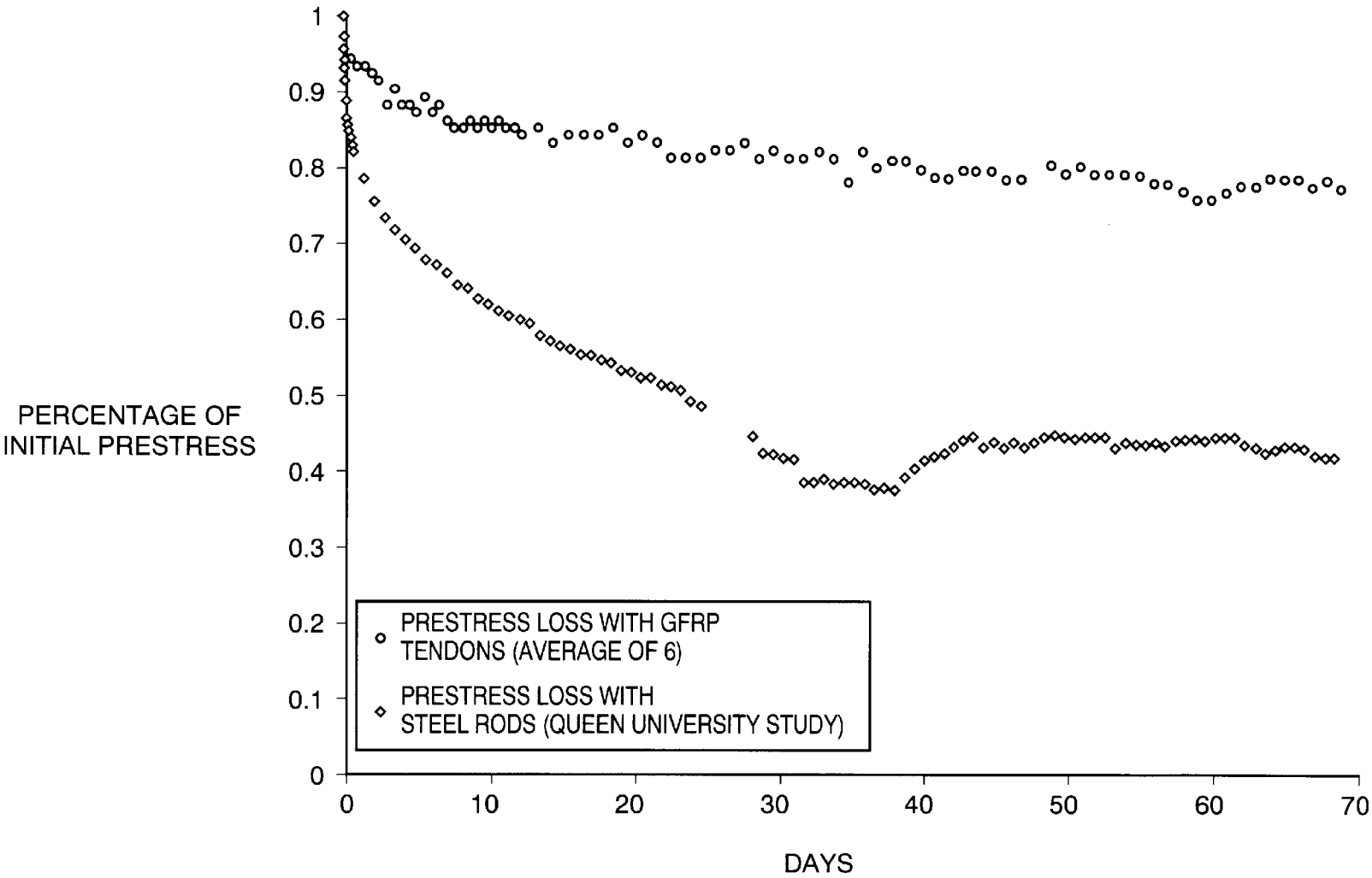
FIG. 8 is a graph comparing prestress losses using steel rods versus prestress losses using GFRP tendons.

As shown in FIG. 8, following 70 days of daily monitoring of the prestress force in the six instrumented tendons, the ambient temperature relative humidity, and the moisture content of the deck, the average prestress force in the deck appeared to have stabilized at nearly 80% of its initial value. The results shown in FIG. 8 represent an average of the six load cells and the small fluctuations in the average prestressing force can be attributed primarily to the two hydraulic load cells responding to changes in the ambient temperature. This data on the GFRP prestress loss is compared with that obtained for steel threadbars from a Queen University study utilizing a similar test set-up. It is clear that the GFRP tendons significantly reduce the prestress losses. After 70 days, the GFRP prestress loss appears to have nearly stabilized at 20% of the initial prestress. The corresponding value for the steel threaded bars used in Queen's University study was about 55% of the initial prestress and still decreasing.

Based upon the test results presented in FIG. 8, it was concluded that:

(1) The GFRP system can significantly reduce the prestress losses compared to that of a commonly used steel threadbar systems. After 70 days, the prestress losses have stabilized at nearly 20% for the GFRP system and they were at 55% for a comparable steel threaded bar system tested at Queen University.

(2) Because of the reduction in prestress losses, the initial prestress in the GFRP system does not need to be as high as is currently used in steel threadbar systems, i.e. 860 kPa (125 psi). For the configuration tested, with an initial wood prestress of 520 kPa (75 psi), the residual prestress after 70 days is nearly 0.8×520 kPa=416 kPa (60 psi). With a steel threaded bar stressing system such as the one used in Queen's university study, and an initial prestress of 860 kPa (125 psi), the remaining prestress after 70 days is nearly 0.45×860 kPa=387 kPa (56 psi), which is slightly less than the remaining prestress with the GFRP system after the same period.

(3) The GFRP system significantly reduced the number of passes required to complete the initial prestress. For the tested configuration, only two passes were required.

(4) Smaller bearing plates than is required for steel could be used, because of the lower prestress forces. Further experimentation has shown that compression molded GFRP plates are a desirable replacement for steel bearing plates. They are significantly lighter and easier to handle during construction and are more resistant to corrosion and other environmental effects.

(5) It is possible to avoid re-stressing in service due to the relative stability of the system over time.

Figure 9A:
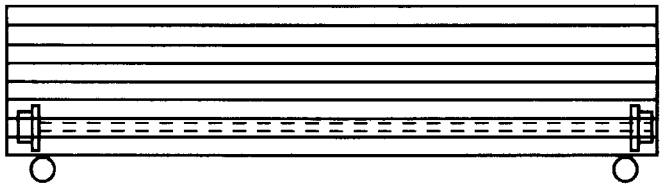
FIG. 9 is a side view of a post-tensioned glulam beam having a prestressing tendon and recessed anchors.
Figure 9B:
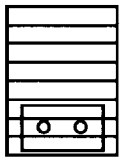
Figure 10A:
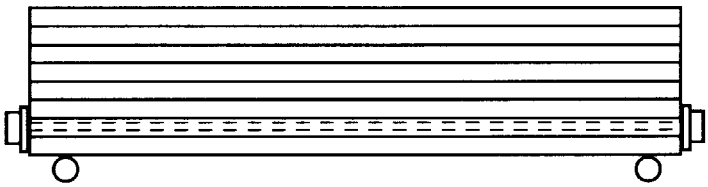
FIG. 10 is a side view of a post-tensioned glulam beam having a prestressing tendon and exposed anchors.
Figure 10B:
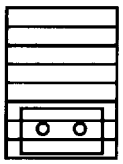
Figure 11A:
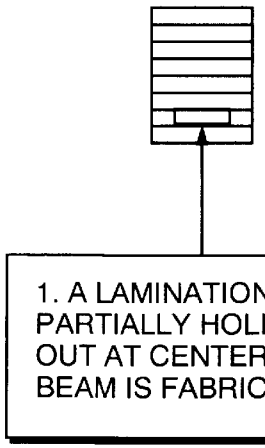
FIG. 11 is a series of end views illustrating the process of fabrication of a RSWSS prestressed glulam beam.
Figure 11B:
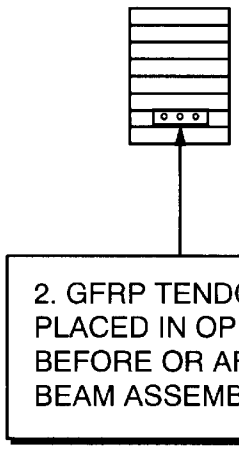
Figure 11C:
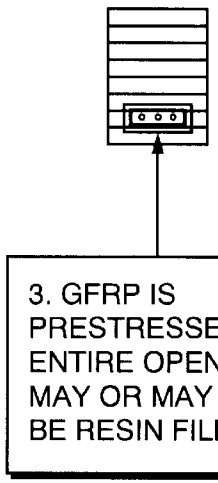
Figure 11D:
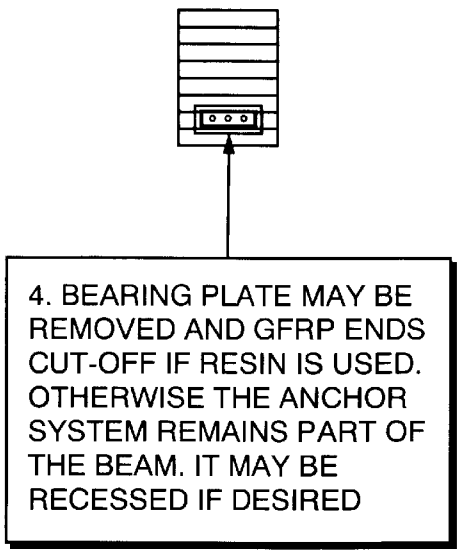

The present invention is also directed to glulam girders prestressed, or post-tensioned with GFRP tendons, as shown in FIGS. 9, 10 & 11. The use of GFRP tendons reduces prestress losses and increases the strength, stiffness and ductility of the girders. GFRP prestressing can also be used to reduce the amount and quality of the wood required in the girders.

There are a number of ways to prestress Glulam girders using a RSWSS. As described in FIG. 11, a wood lamination may be partially hollowed out to accept one or more prestressing tendons. Once the beam is fabricated and cured, the FRP tendon(s) are post-tensioned. A number of prestressing systems may be used to accomplish this, including the example shown in FIG. 7. Once the desired prestress force is applied, the entire tendon opening 28 may be injected with a resin. With the resin cured, the tendon end anchors may be removed and the tendon may be cut flush with the end of the beam.

Whether or not resin is used, the end anchor system may be left attached to the tendons and either be recessed in the end of the beam, as shown in FIG. 9, or remain permanently projecting a small distance from the ends of the beam, as shown in FIG. 10. This allows non resin-filled beams to be easily post-tensioned and provides additional security that resin filled beams will remain stressed. In addition, a variety of art recognized external post-tensioning systems utilizing tendons arranged parabolically, catenary, draped, or deflected at a specific point may be improved by using the RSWSS of the present invention.

While there have been described what are at present considered to be the preferred embodiments of this invention, it will be obvious to those skilled in the art that various changes and modifications may be made therein without departing from the invention and it is, therefore, aimed to cover all such changes and modifications as fall within the true spirit and scope of the invention.

What is claimed is:

1. A prestressing system for wood elements and structures comprising:

a plurality of members;

a prestressing tendon manufactured from a glass fiber reinforced plastic having a material stiffness less than a material stiffness of steel, said prestressing tendon having two ends and being disposed in such a manner as to fasten together said plurality of members; and a stressing mechanism attached to at least one end of said prestressing tendon to exert a tensile force on said prestressing tendon and a substantially equal and opposite compressive force on said plurality of members such that said plurality of members are drawn together.

2. The system as claimed in claim 1 wherein said plurality of members are arranged in side by side relation to form a deck, wherein said deck includes a series of aligned holes through said plurality of members, and wherein said prestressing tendon passes through said series of aligned holes.

3. The system as claimed in claim 1 further comprising at least two girders, each having a first end and a second end, and wherein said plurality of members are arranged in side by side relation to form a deck between said girders such that ends of said plurality of members are aligned in substantially parallel relation to said first ends of said girders to form a T, wherein said T includes a series of aligned holes through said plurality of members and said at least two girders, and wherein said prestressing tendon passes through said series of aligned holes.

4. The system as claimed in claim 1 further comprising at least two girders, each having a first end and a second end, and a second prestressing tendon, and wherein said plurality of members are arranged in side by side relation to form a first deck and a second deck between said girders such that ends of said plurality of members making up said first deck are aligned in substantially parallel relation to said first ends of said girders and such that ends of said plurality of members making up said second deck are aligned in substantially parallel relation to said second ends of said girders to form a box, wherein said box includes a first series of aligned holes through said first deck and said girders and a second series of aligned holes through said second deck and said girders, and wherein said prestressing tendon passes through said first series of aligned holes in said first deck and said at least two girders and wherein said second prestressing tendon passes through said second series of aligned holes in said second deck and said girders.

5. The system as claimed in claim 1 wherein said plurality of members is arranged to form a truss.

6. The system as claimed in claim 5 wherein said truss comprises three members, wherein a first member is arranged in a substantially horizontal position and a second member and a third member are arranged substantially perpendicular to, and in abutting relation with, said first member, and wherein said prestressing tendon extends from a first end of said first member across non-abutting ends of said second member and said third member and terminates at a second end of said first member.

7. The system as claimed in claim 5 wherein said truss comprises two members, wherein a first member is arranged in a substantially horizontal position and a second member is arranged substantially perpendicular to, and in abutting relation with, a center of said first member, and wherein said prestressing tendon extends from a first end of said first member across a non-abutting end of said second member and terminates at a second end of said first member.

8. A prestressing and post-tensioning system comprising:

a beam;

a tendon having a first end and a second end, said tendon being manufactured from a glass fiber reinforced plastic having a material stiffness less than a material stiffness of steel;

an opening disposed longitudinally through said beam, said opening being dimensioned to accommodate said tendon;

a first anchor disposed at said first end of said tendon and a second anchor disposed at said second end of said tendon; and a pair of bearing plates disposed about each end of said tendon between the anchors and a pair of bearing surfaces of said beam;

wherein said tendon is disposed within said opening, the bearing plates are disposed against the bearing surfaces and the anchors are tightened such that a tensile force is exerted on said tendon and such that said bearing plates exert a substantially equal and opposite compressive force on said beam.

9. The system as claimed in claim 8 wherein said beam comprises a plurality of layers of lamination and wherein said opening is disposed through at least one of said plurality of layers of lamination.

10. The system as claimed in claim 8 wherein said beam is a chosen from a group consisting of glulam beams, LVL beams, and SCL beams.

11. The system as claimed in claim 8 further comprising a resin injected into said opening to hold said tendon in a prestressed position.

12. The system as claimed in claim 11 wherein said beam further comprises a weep hole to allow said resin to flow out of said beam.

13. A method for prestressing a beam comprising the steps of:

a) providing a beam;

b) forming an opening longitudinally through said beam;

c) disposing a glass fiber reinforced plastic tendon having a material stiffness less than a material stiffness of steel through the opening in said beam;

d) attaching a pair of bearing plates and a pair of anchors to a pair of ends of said tendon; and e) tightening said anchors such that said bearing plates bear against said beam.

14. The method as claimed in claim 13 further comprising the step of filling the opening with a resin after said anchors have been tightened.

15. The method as claimed in claim 13 further comprising the step of removing the anchor and bearing plate after said resin has cured.

16. The method as claimed in claim 13 further comprising the step of counterboring an area about the opening at each end of said beam such that said bearing plates and anchors do not extend beyond the ends of said beam.

* * * * *